US010490949B2

(12) United States Patent
Rascon et al.

(10) Patent No.: US 10,490,949 B2
(45) Date of Patent: Nov. 26, 2019

(54) INTEGRATED CONNECTOR APPARATUS FOR PCIE APPLICATIONS

(71) Applicant: Pulse Electronics, Inc., San Diego, CA (US)

(72) Inventors: Thomas Rascon, San Diego, CA (US); Thuyen Dinh, San Diego, CA (US); Mohammad Saboori, San Diego, CA (US)

(73) Assignee: Pulse Electronics, Inc., San Diego, CA (US)

( * ) Notice: Subject to any disclaimer, the term of this patent is extended or adjusted under 35 U.S.C. 154(b) by 0 days.

(21) Appl. No.: 15/920,224

(22) Filed: Mar. 13, 2018

(65) Prior Publication Data

US 2018/0269633 A1 Sep. 20, 2018

Related U.S. Application Data

(60) Provisional application No. 62/471,840, filed on Mar. 15, 2017.

(51) Int. Cl.

| | |
|---|---|
| ***H01R 24/00*** | (2011.01) |
| ***H01R 13/6587*** | (2011.01) |
| ***H01R 12/72*** | (2011.01) |

(52) U.S. Cl.

CPC ..... *H01R 13/6587* (2013.01); *H01R 12/721* (2013.01); *H01R 12/724* (2013.01)

(58) Field of Classification Search

CPC ..... H01R 13/518; H01R 23/7073; H01R 13/65802; H01R 13/65805; H01R 23/688; H01R 23/025; H01R 13/6616; H01R 13/6658; H05K 9/0062; H05K 9/0032; H05K 9/0039; H05K 9/0015

USPC ..... 439/540.1, 541.5, 607.01, 607.03, 439/607.07–607.09, 607.25, 607.26, 439/607.35, 620.21–620.23, 676; 361/800, 816, 818, 819; 174/377

See application file for complete search history.

(56) References Cited

U.S. PATENT DOCUMENTS

| | | | | |
|---|---|---|---|---|
| 5,639,267 A * | 6/1997 | Loudermilk | ..... | H01R 13/518 439/607.27 |
| 5,924,890 A * | 7/1999 | Morin | ..... | H01R 13/641 439/490 |
| 5,934,940 A * | 8/1999 | Maranto | ..... | H01R 13/74 439/607.25 |
| 6,155,872 A | 12/2000 | Wu | | |
| 6,227,911 B1 * | 5/2001 | Boutros | ..... | H01R 13/719 439/490 |

(Continued)

*Primary Examiner* — Thanh Tam T Le

(74) *Attorney, Agent, or Firm* — Gazdzinski & Associates, PC

(57) ABSTRACT

An integrated connector module (ICM) is disclosed. In one embodiment, the ICM includes a plurality of shielding components, the plurality of shielding components comprising a port to port shield, an insert to insert shield and a main body shield. The ICM also contains one or more housing components, the one or more housing components comprising a plurality of ports that are arranged so as to be offset from a main signal conditioning portion of the one or more housing components; and an electronics assembly disposed within the one or more housing components. Methods and apparatus for utilizing and manufacturing the aforementioned ICM are also disclosed.

23 Claims, 15 Drawing Sheets

(56) References Cited

U.S. PATENT DOCUMENTS 6,478,621 B2 * 11/2002 Ma ..... H01R 13/6485 439/540.1
6,511,348 B1 * 1/2003 Wojtacki ..... H01R 12/724 439/541.5
6,558,191 B2 * 5/2003 Bright ..... G02B 6/4246 439/541.5
6,729,905 B1 * 5/2004 Hwang ..... H05K 9/0058 439/607.21
6,743,047 B2 * 6/2004 Korsunsky ..... H01R 13/659 439/540.1
7,044,777 B1 * 5/2006 Daly ..... H01R 13/6582 439/540.1
7,121,898 B2 * 10/2006 Murr ..... H01R 24/64 439/676
7,241,181 B2 7/2007 Machado et al.
7,357,673 B2 * 4/2008 Long ..... H05K 9/0058 439/607.2
7,488,212 B2 * 2/2009 Chen ..... G02B 6/4277 439/607.01
7,674,136 B2 * 3/2010 Steinke ..... H01R 13/514 439/541.5
7,819,699 B2 * 10/2010 Xu ..... H01R 13/514 439/620.09
8,460,029 B1 * 6/2013 Chen ..... H01R 13/659 439/540.1
8,758,063 B2 * 6/2014 Zhang ..... H01R 13/405 439/676
8,869,383 B2 * 10/2014 Xu ..... H01F 17/062 29/602.1
8,888,538 B2 * 11/2014 Regnier ..... H01R 12/724 439/676
8,992,248 B2 * 3/2015 O'Malley ..... H01R 13/6469 439/541.5
9,077,120 B2 * 7/2015 Zhang ..... H01R 13/6658
9,130,315 B2 * 9/2015 O'Malley ..... H01R 13/6469
9,153,897 B2 10/2015 Chen et al.
9,178,318 B2 * 11/2015 Rascon ..... H01R 13/6581
9,401,561 B2 7/2016 Zhou et al.
9,716,344 B2 7/2017 Zhou et al.
2010/0041274 A1 2/2010 Marti et al.
2011/0230097 A1 9/2011 Dunwoody et al.
2013/0094153 A1 4/2013 Teo et al.
2013/0288526 A1 10/2013 Rascon et al.

* cited by examiner

INTEGRATED CONNECTOR APPARATUS FOR PCIE APPLICATIONS

PRIORITY

This application claims the benefit of priority to U.S. Provisional Patent Application Ser. No. 62/471,840 of the same title filed Mar. 15, 2017, the contents of which being incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. TECHNOLOGICAL FIELD

The present disclosure relates generally to electronic components, and particularly to an improved design for, and method of manufacturing single- or multi-port integrated connector modules (ICM) which include internal electronic components.

2. DESCRIPTION OF RELATED TECHNOLOGY

Modular connectors, such as for example those of the "RJ" configuration, are well known in the electronics industry. Such connectors are adapted to receive one or more modular plugs of varying type (e.g., RJ-45 or RJ-11), and communicate signals between the terminals of the modular plug and the parent device with which the connector is associated. Commonly, some form of signal conditioning (e.g., filtering, voltage transformation, or the like) is performed by the connector on the signals passing through it. These connectors which include signal conditioning circuitry are more recently known as Integrated Connector Modules (ICMs).

Many different considerations are involved with producing an effective and economically viable connector design. Such considerations include, for example: (i) volume and "footprint" available for the connector; (ii) the need for electrical status indicators (e.g., LEDs); (iii) the cost and complexity associated with assembling and manufacturing the device; (iv) the ability to accommodate various electrical components and signal conditioning configurations; (v) the electrical and noise performance of the device; (vi) the reliability of the device; (vii) the ability to modify the design to accommodate complementary technologies; (viii) compatibility with existing terminal and "pin out" standards and applications; (ix) ability to configure the connector as one of a plurality of ports, potentially having individually variant internal component configurations, and (ix) potentially the maintenance or replacement of defective components.

The aforementioned volume and footprint available has been complicated with the adoption of differing standards such as Peripheral Component Interconnect Express (PCIe). The PCIe standard has limited the available space for RJ style connectors; in particular it has limited the amount of space available for the adoption of ICM solutions for these PCIe compliant printed circuit boards (PCBs). Moreover, increasing requirements for data connectivity and capability are driving greater adoption of these connectors across a broader spectrum of applications. Increased data rate requirements, such as those mandated under so-called "gigabit Ethernet" (GBE) standards (e.g., 1G, 5G, 10G, and the like), are also increasing the performance demands on these connectors. As more capability and components (such as both discrete and integrated circuitry) are disposed within the connector, more efficient use of the available volume within the connector, as well as shielding for the prevention of deleterious electromagnetic interference (EMI), are also required.

Accordingly, it would be desirable to provide an improved ICM that is capable of being deployed within high performance and limited footprint availability applications such as the aforementioned PCIe. Such an ICM design would ideally allow for the ready use of a variety of different electronic signal conditioning components in the connector signal path(s), as well as status indicators if desired. The improved ICM design would also facilitate easy assembly, as well as ease of integration into complicated footprint requirements. The design would further be amenable to integration into single or multi-port ICMs, including the ability to vary the configuration of the internal components associated with individual port pairs of the assembly when desired.

SUMMARY

The present disclosure satisfies the aforementioned needs by providing, inter alia, an improved ICM assembly for adoption with, inter alia, PCIe applications and methods for manufacturing and using the same.

In one aspect, an integrated connector module (ICM) is disclosed. In one embodiment, the ICM includes a plurality of shielding components, the plurality of shielding components including a port to port shield, an insert-to-insert shield and a main body shield; one or more housing components, the one or more housing components comprising a plurality of ports that are arranged so as to be offset from a signal conditioning portion of the one or more housing components; and an electronics assembly disposed within the signal conditioning portion of the one or more housing components.

In one variant, each of the port to port shield, the insert-to-insert shield and the main body shield each are discrete shielding elements.

In another variant, the ICM further includes a plurality of header inserts and an upper substrate, at least a portion of the electronics assembly being collectively disposed within the plurality of header inserts and the upper substrate.

In yet another variant, the upper substrate is disposed atop the plurality of header inserts, the upper substrate comprising a unitary component such that the upper substrate is common to each of the plurality of header inserts.

In yet another variant, the port to port shield further includes a port to port shielding tab, the port to port shielding tab configured to engage the main body shield.

In yet another variant, the main body shield includes a front shield and a back shield, the port to port shielding tab configured to engage the front shield.

In yet another variant, the insert-to-insert shield includes a rear shielding tab, the rear shielding tab configured to engage the back shield.

In yet another variant, the one or more housing components includes at least two housing components, the at least two housing components configured to engage one another via the use of one or more mortise/tenon joints.

In another embodiment, the ICM includes a main housing having a plurality of header inserts mounted at least partially therein, the plurality of header inserts having an upper substrate mounted thereto; a plurality of shielding components, the plurality of shielding components including: a port to port shield, the port to port shield being disposed between adjacent ports located within the main housing; an insert-to-insert shield, the insert-to-insert shield being disposed between adjacent ones of the plurality of header inserts; and a main body shield, the main body shield being disposed at least partly about the main housing; and an electronics assembly disposed within a signal conditioning portion of the main housing.

In one variant, use of the port to port shield enables suppression of Alien Near End Crosstalk (ANEXT) as compared with a similar ICM that does not contain the port to port shield.

In another variant, the port to port shield further includes a port to port shielding tab, the port to port shielding tab configured to resiliently engage the main body shield.

In yet another variant, the main body shield includes a front shield and a back shield, the port to port shielding tab configured to resiliently engage the front shield.

In yet another variant, the insert-to-insert shield includes a rear shielding tab, the rear shielding tab configured to resiliently engage the back shield.

In yet another variant, the insert-to-insert shield is a discrete shielding element from the port to port shield.

In yet another variant, the main housing collectively includes a port portion and a signal conditioning portion, the port portion being offset from the signal conditioning portion.

In yet another variant, the main housing includes a front housing and rear housing, the front housing including both the port portion and the signal conditioning portion.

In yet another variant, the rear housing includes both the port portion and the signal conditioning portion.

In another aspect, a printed circuit card is disclosed. In one embodiment, the printed circuit card is for use in a standardized application and includes a printed circuit board having an integrated connector module mounted thereon; and an input/output (I/O) mounting bracket. The integrated connector module includes: a plurality of shielding components, the plurality of shielding components including a port to port shield, an insert-to-insert shield and a main body shield; one or more housing components, the one or more housing components including a plurality of ports that are arranged so as to be offset from a signal conditioning portion of the one or more housing components; and an electronics assembly disposed within the signal conditioning portion of the one or more housing components.

In one variant, the standardized application is in accordance with a Peripheral Component Interconnect Express (PCIe) application.

In another variant, the main body shield includes a mounting bracket engagement feature, the mounting bracket engagement feature including a resilient portion configured to apply pressure to the I/O mounting bracket.

In yet another aspect, a communications apparatus that includes the aforementioned printed circuit card is disclosed. In one embodiment, the communications apparatus printed circuit card includes a printed circuit board having an integrated connector module mounted thereon; and an input/output (I/O) mounting bracket. The integrated connector module includes: a plurality of shielding components, the plurality of shielding components including a port to port shield, an insert-to-insert shield and a main body shield; one or more housing components, the one or more housing components including a plurality of ports that are arranged so as to be offset from a signal conditioning portion of the one or more housing components; and an electronics assembly disposed within the signal conditioning portion of the one or more housing components.

In yet another aspect, methods of manufacturing the aforementioned ICM are disclosed.

In yet another aspect, methods of manufacturing the aforementioned printed circuit card are disclosed.

In yet another aspect, methods of manufacturing the aforementioned communications apparatus are disclosed.

In yet another aspect, methods of using the aforementioned ICM are disclosed.

Various objects, features, aspects and advantages of the inventive subject matter will become more apparent from the following detailed description of preferred embodiments, along with the accompanying drawings.

BRIEF DESCRIPTION OF THE DRAWINGS

FIG. 1I is a perspective view of an insert-to-insert shield assembly for use with the ICM of FIG. 1A, in accordance with the principles of the present disclosure.

Figure 1:
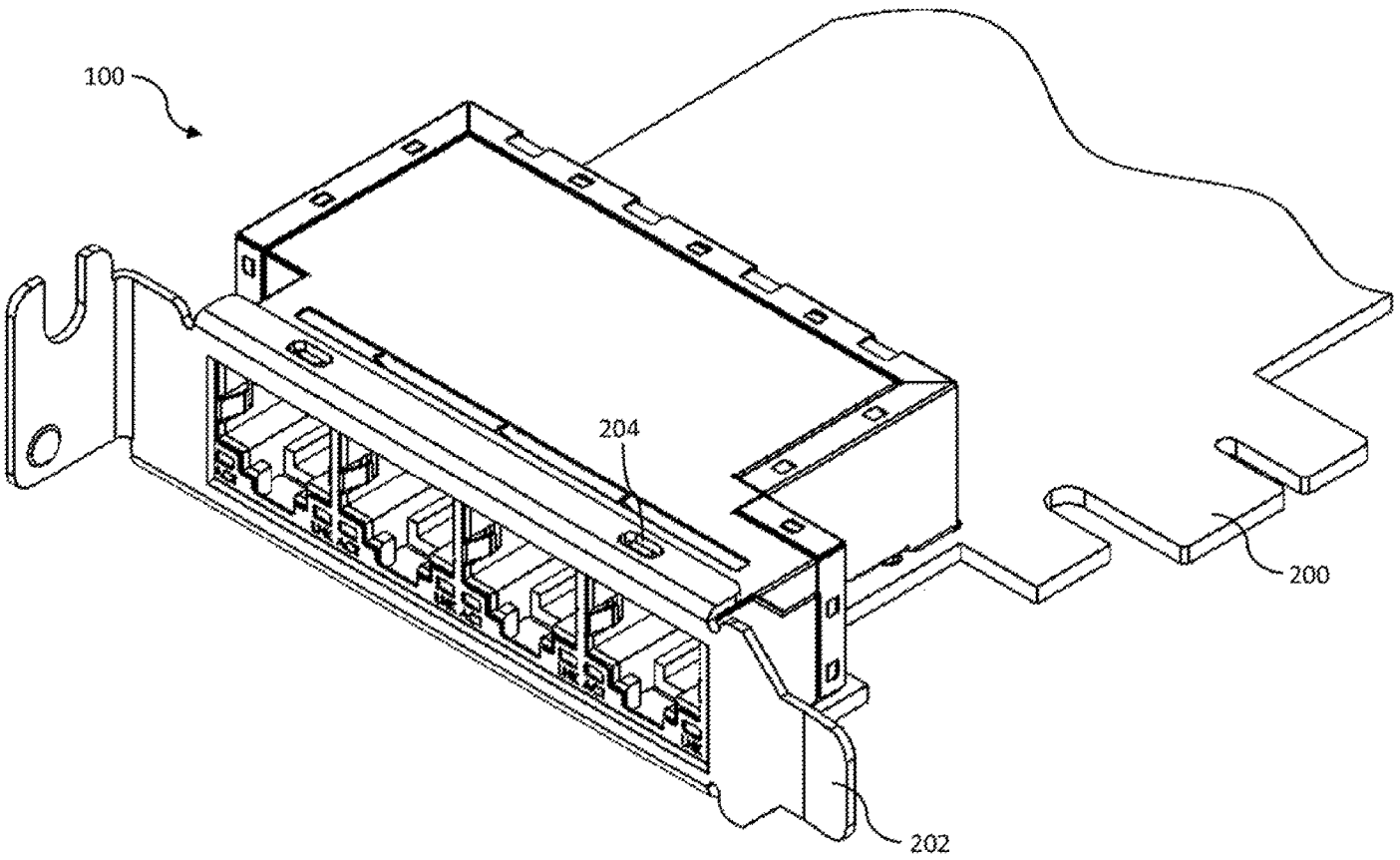
FIG. 1 is a perspective view of an exemplary embodiment of an ICM installed within a PCIe application in accordance with the principles of the present disclosure.

All Figures disclosed herein are © Copyright 2017-2018 Pulse Electronics, Inc. All rights reserved.

DETAILED DESCRIPTION

Reference is now made to the drawings wherein like numerals refer to like parts throughout.

It is noted that while the following description is cast primarily in terms of a plurality of RJ-type connectors and associated modular plugs of the type well known in the art, the present disclosure may be used in conjunction with any number of different connector types. Accordingly, the following discussion of the RJ connectors and plugs is merely exemplary of the broader concepts.

As used herein, the terms "electrical component" and "electronic component" are used interchangeably and refer to components adapted to provide some electrical and/or signal conditioning function, including without limitation inductive reactors ("choke coils"), transformers, filters, transistors, gapped core toroids, inductors (coupled or otherwise), capacitors, resistors, operational amplifiers, and diodes, whether discrete components or integrated circuits, whether alone or in combination.

As used herein, the term "signal conditioning" or "conditioning" shall be understood to include, but not be limited to, signal voltage transformation, filtering, current limiting, sampling, processing, and time delay.

As used herein, the terms "top", "bottom", "side", "up", "down", "upper", "lower", "front", "back" and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

Exemplary Embodiments

Detailed descriptions of the various embodiments and variants of the apparatus and methods of the present disclosure are now provided. While primarily discussed in the context of integrated connector modules (ICM) for use in PCIe applications, the various apparatus and methodologies discussed herein are not so limited. In fact, many of the apparatus and methodologies described herein are useful in the manufacture of any number of electronic or signal conditioning components that can benefit from the ICM geometry and features described herein, which may also be useful in different applications (other than PCIe) and/or provide different signal conditioning functions.

In addition, it is further appreciated that certain features discussed with respect to specific embodiments can, in many instances, be readily adapted for use in one or more other contemplated embodiments that are described herein. It can be readily recognized by one of ordinary skill, given the present disclosure, that many of the features described herein possess broader usefulness outside of the specific examples and implementations with which they are described, and in fact many features shown with respect to one embodiment can be combined with or used in place of those associated with other embodiments.

Moreover, while primarily discussed in the context of a single-row multi-port ICM assembly, it would be readily appreciated that the principles described herein may be readily applied to multi-row multi-port ICM assemblies (e.g., 2×4 ICM configurations) as well as with single-port ICM assemblies. For example, the signal conditioning portion may be offset from the port portion of a single-port ICM assembly in some implementations. These and other variants would be readily apparent to one of ordinary skill given the contents of the present disclosure.

Exemplary ICM Assembly—

Figure 1A:
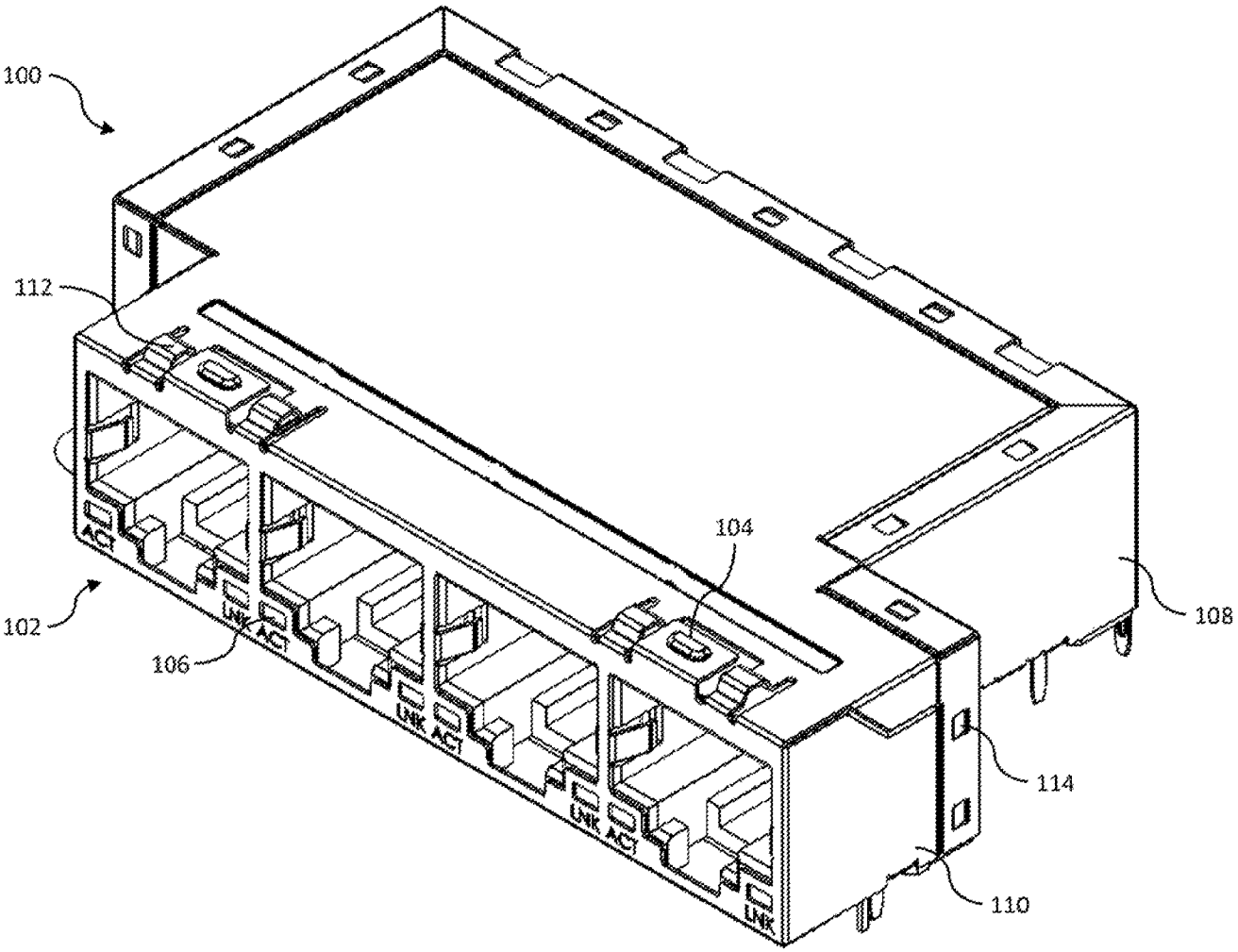
FIG. 1A is a perspective view of the exemplary ICM of FIG. 1, in accordance with the principles of the present disclosure.
Figure 1B:
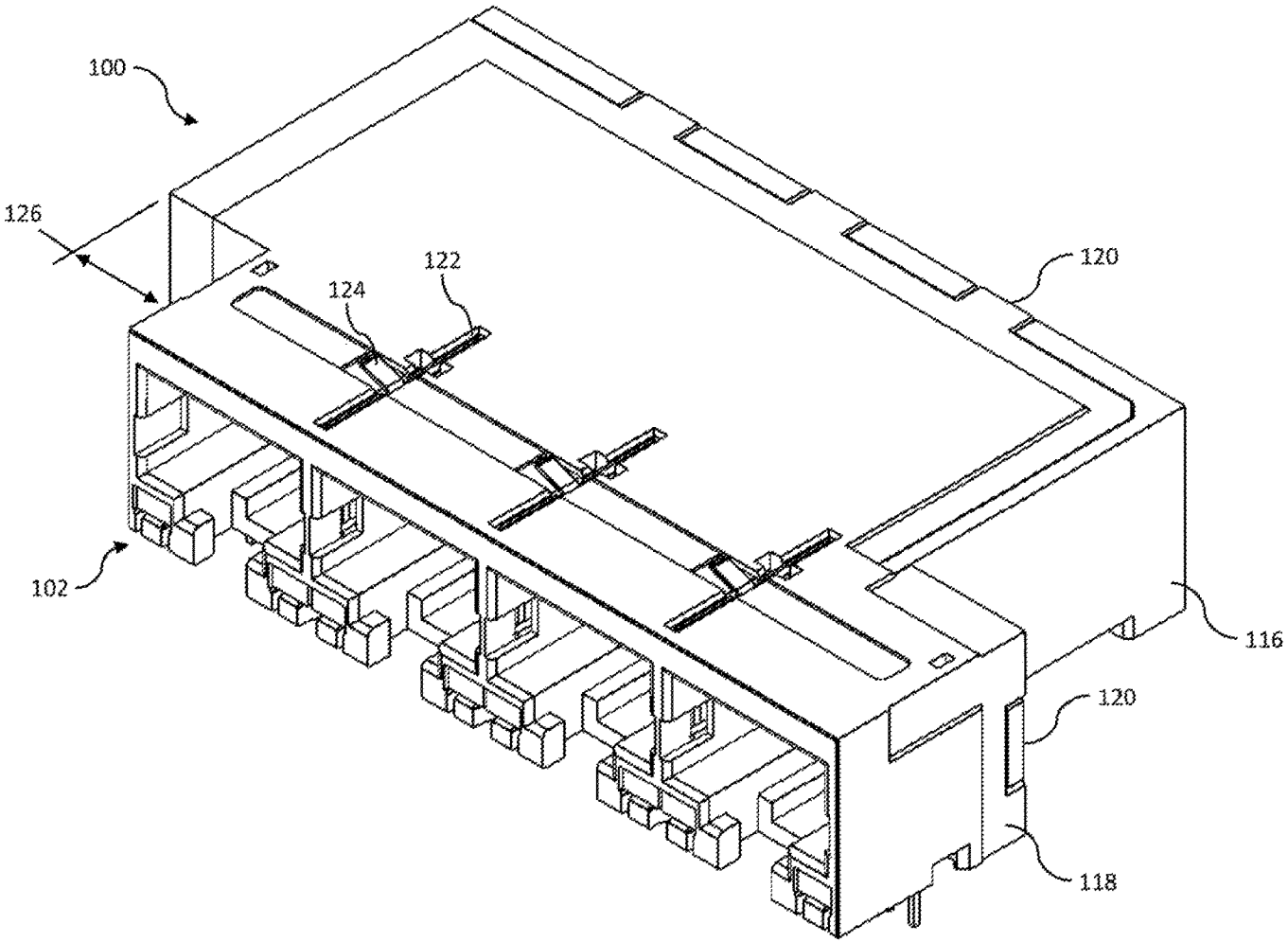
FIG. 1B is a perspective view of the exemplary ICM of FIG. 1A with the external EMI shielding removed from view, in accordance with the principles of the present disclosure.
Figure 1C:
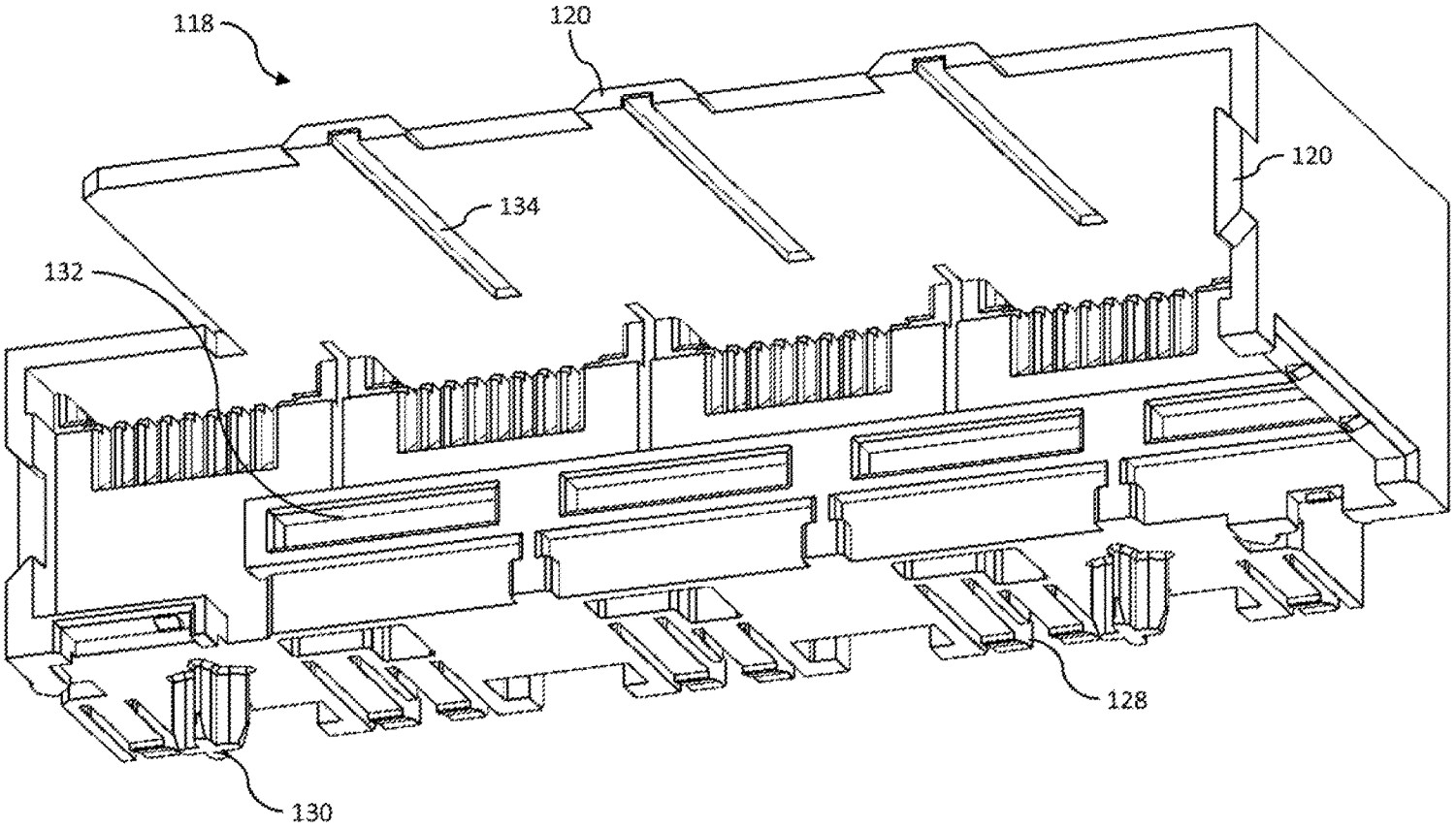
FIG. 1C is a perspective view of the backside of a front housing for the ICM of FIG. 1A, in accordance with the principles of the present disclosure.
Figure 1D:
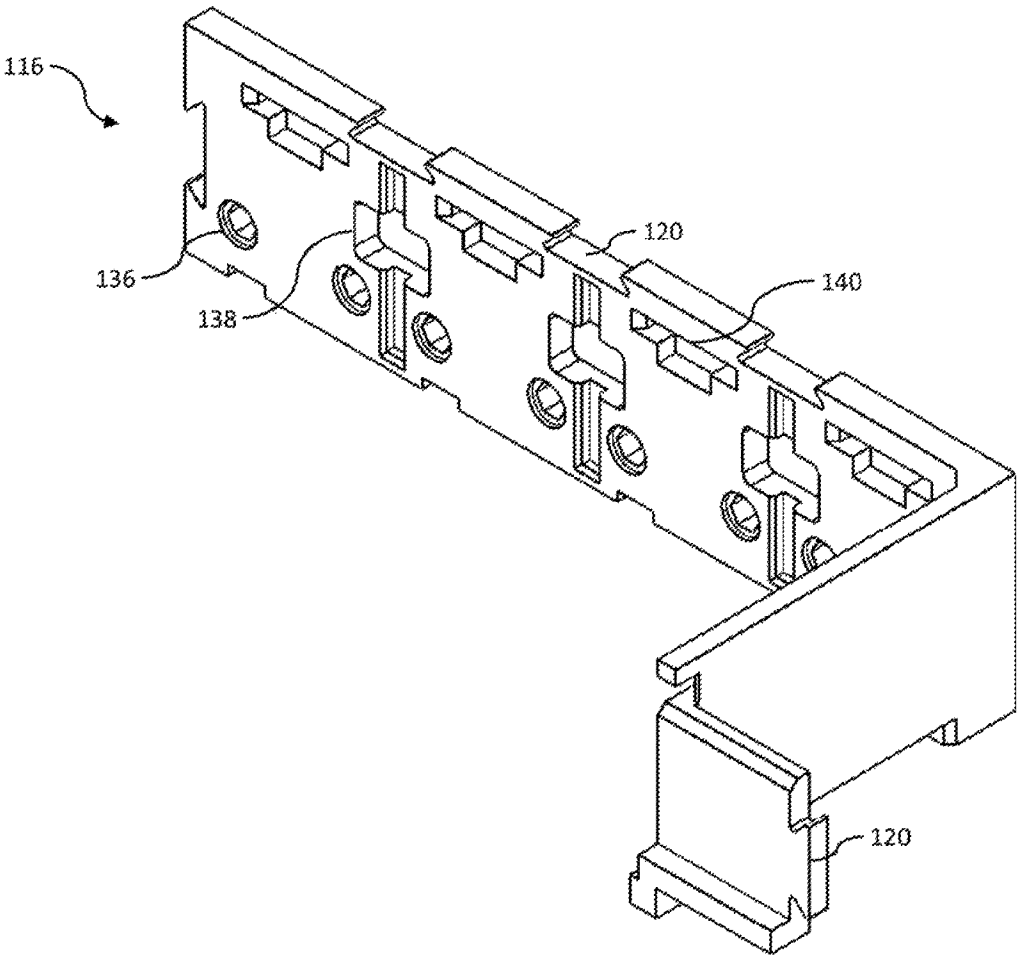
FIG. 1D is a perspective view of a back housing for the ICM of FIG. 1A, in accordance with the principles of the present disclosure.
Figure 1E:
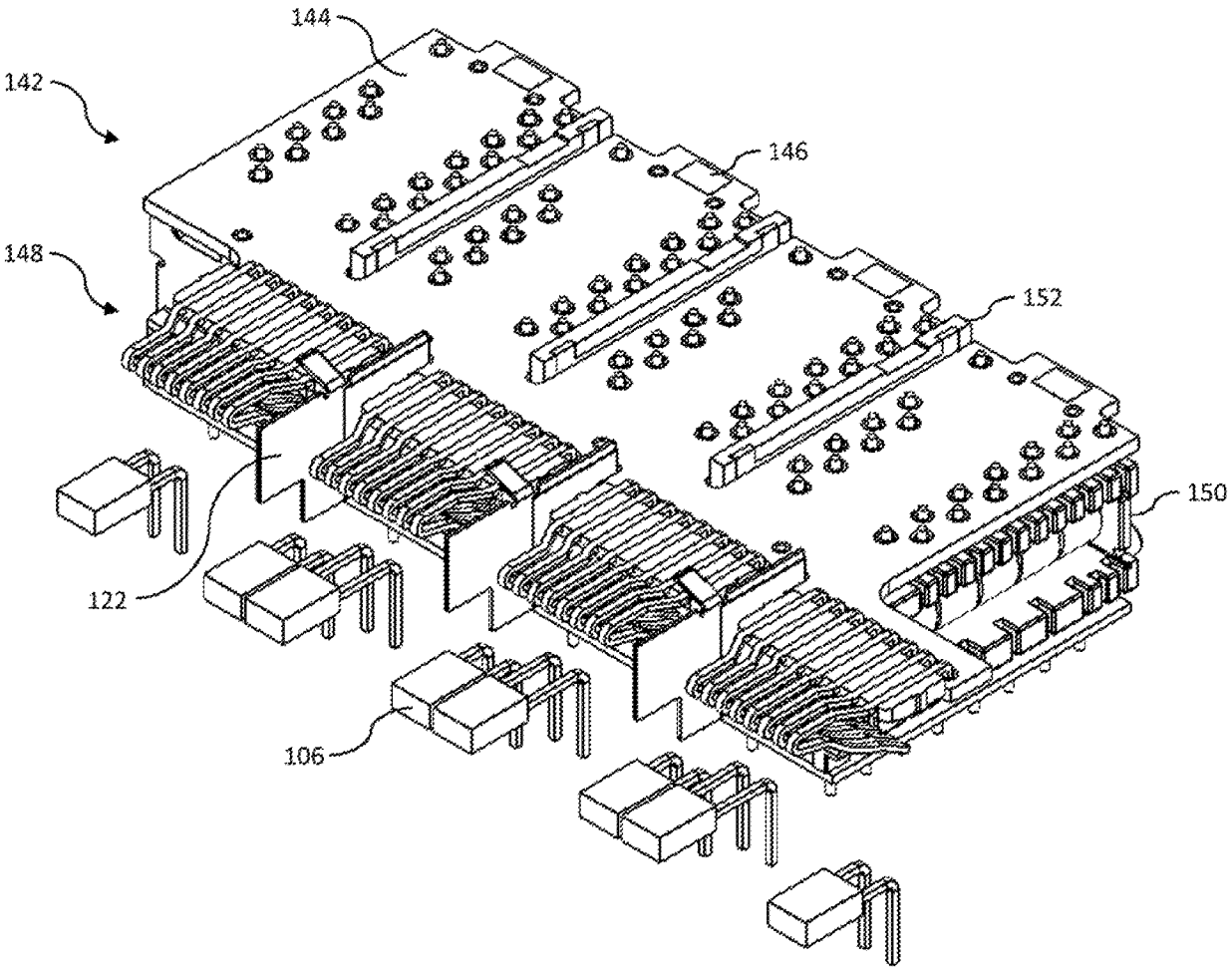
FIG. 1E is a perspective view of an insert assembly for the ICM of FIG. 1A, in accordance with the principles of the present disclosure.
Figure 1F:
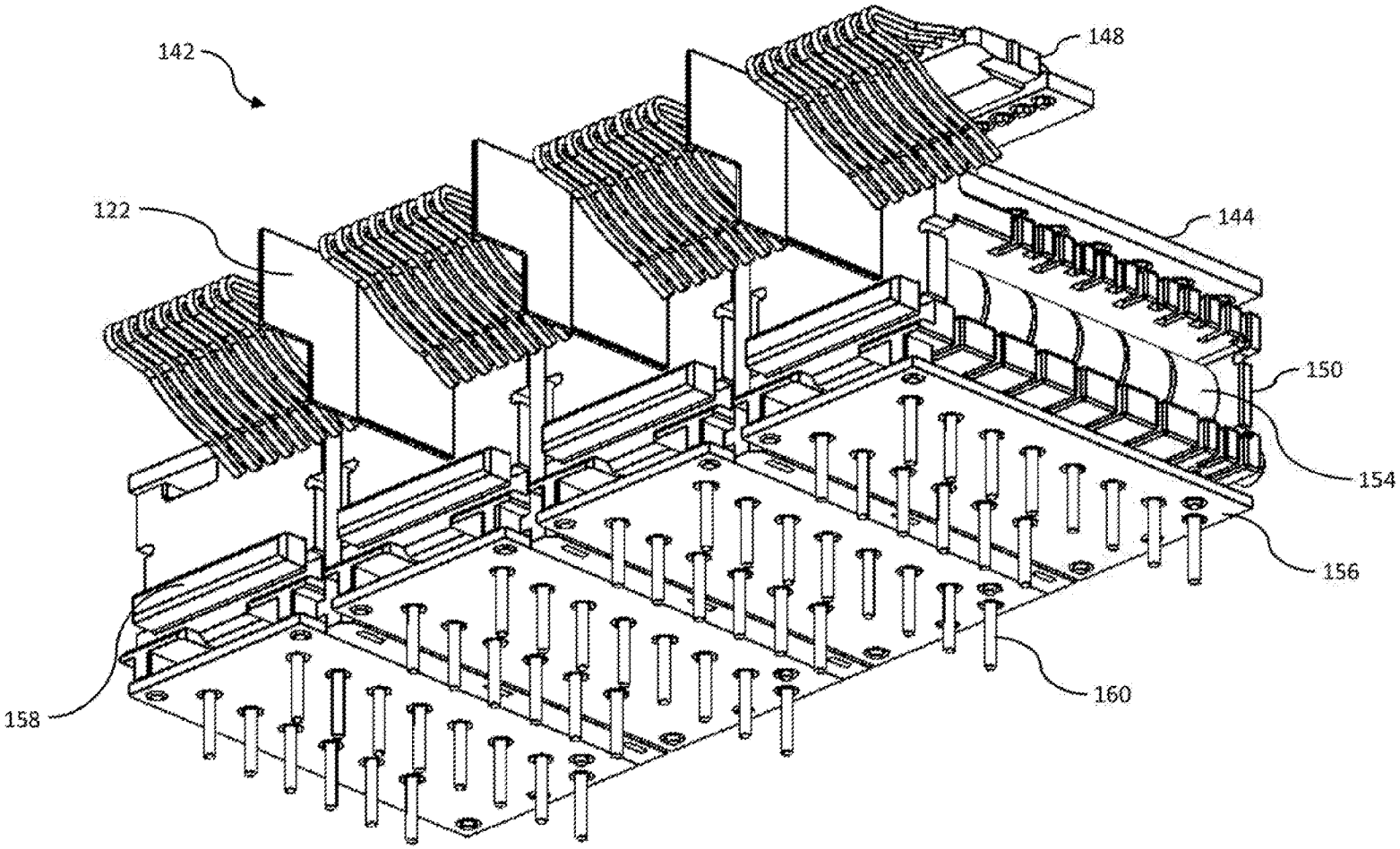
FIG. 1F is a perspective view of the underside of an insert assembly of FIG. 1E, in accordance with the principles of the present disclosure.
Figure 1G:
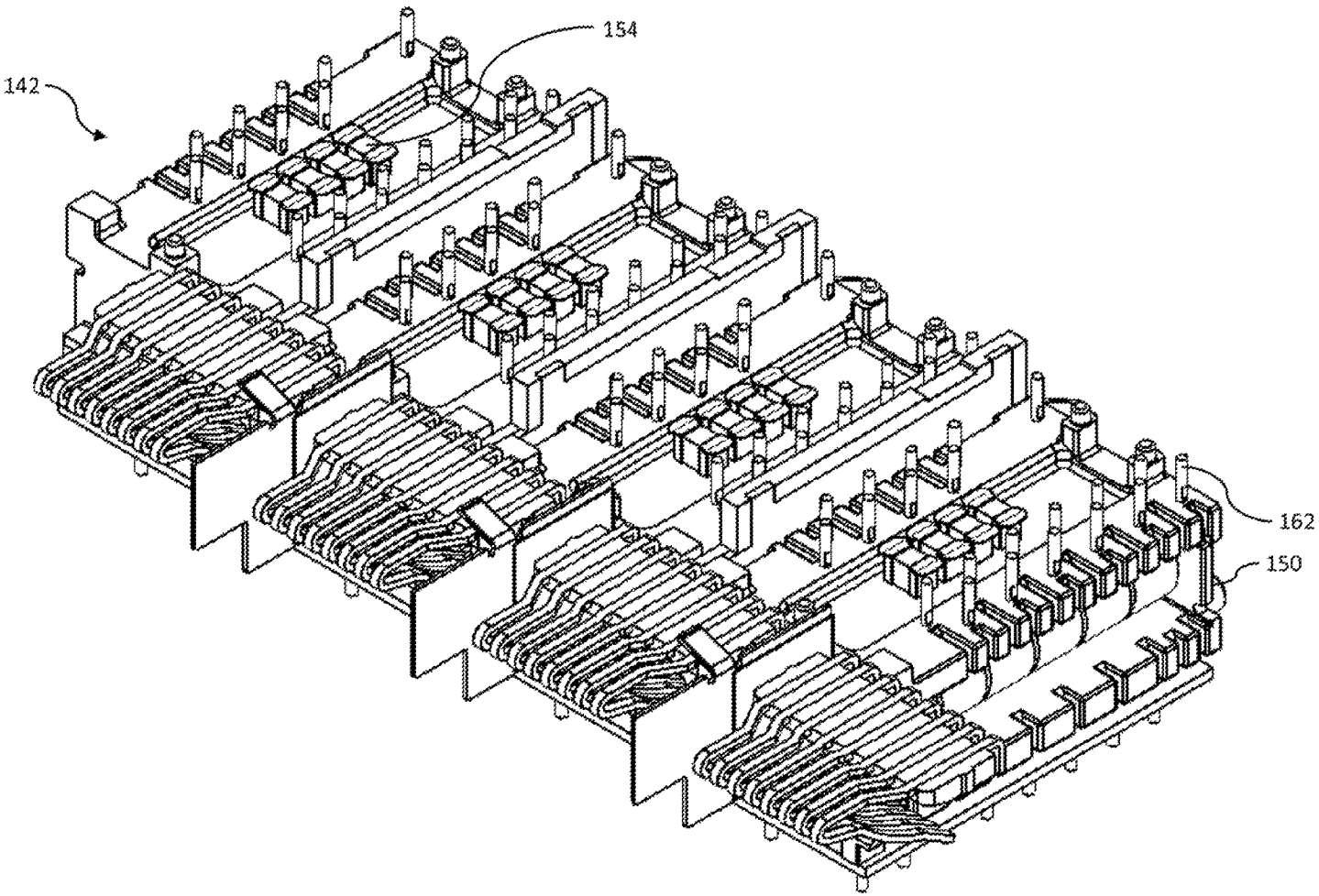
FIG. 1G is a perspective view of an insert assembly of FIG. 1E with the upper substrate removed from view, in accordance with the principles of the present disclosure.
Figure 1H:
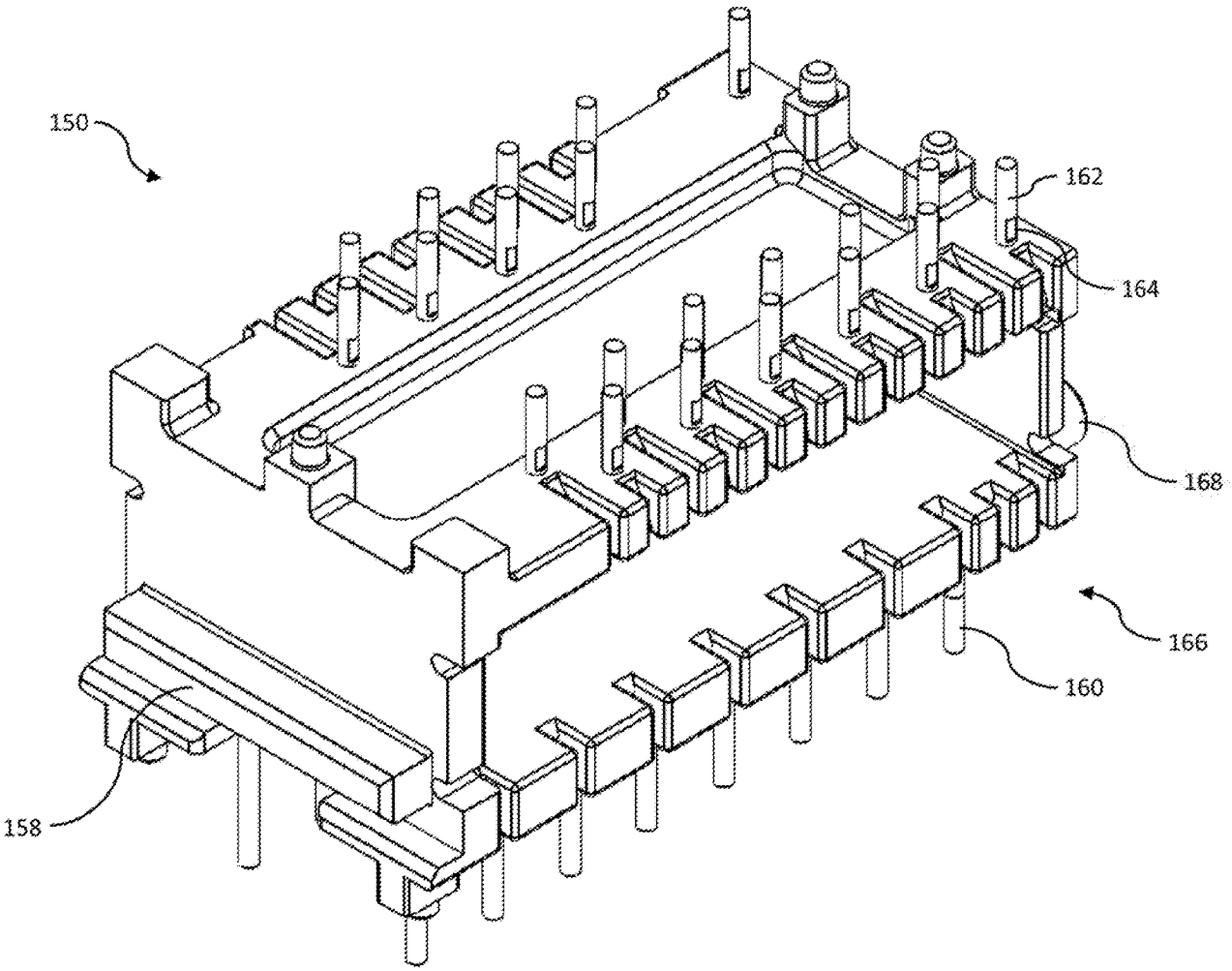
FIG. 1H is a perspective view of a header insert for use with the ICM of FIG. 1A, in accordance with the principles of the present disclosure.
Figure 11:
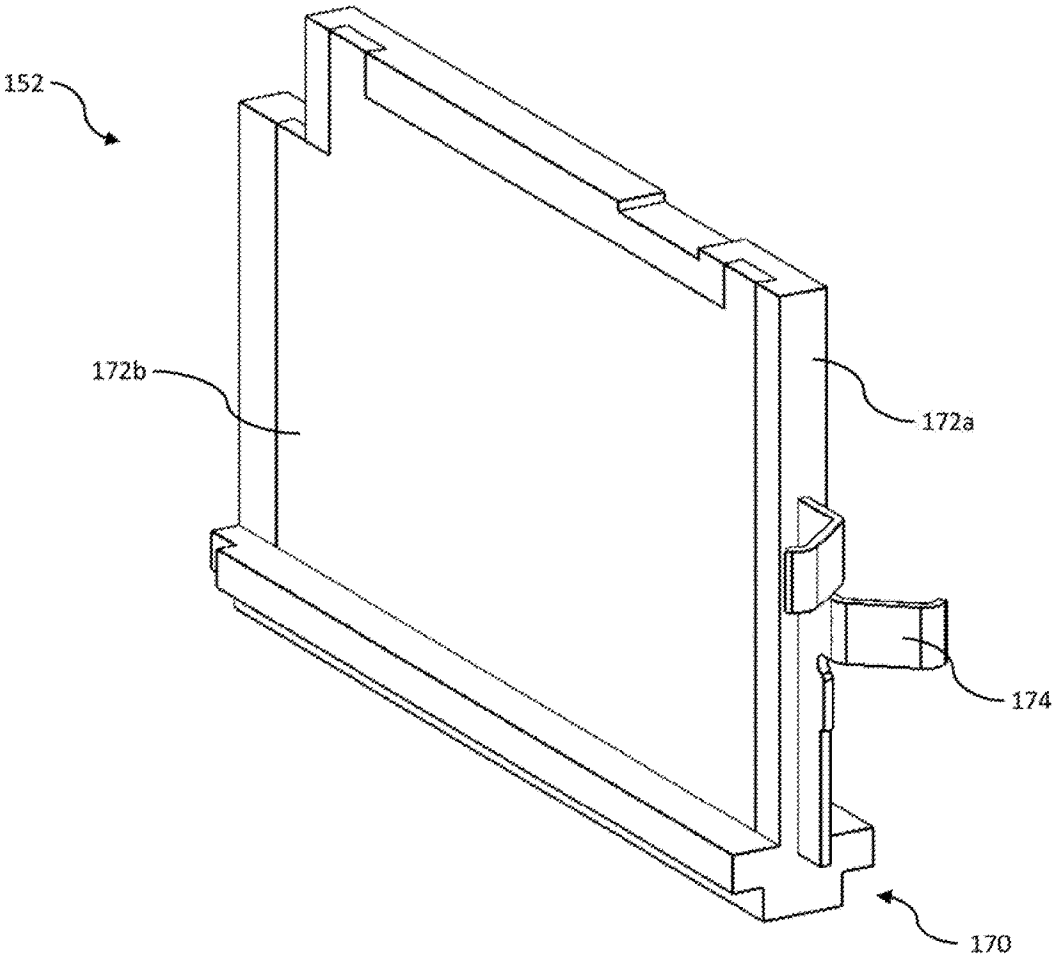
Figure 1J:
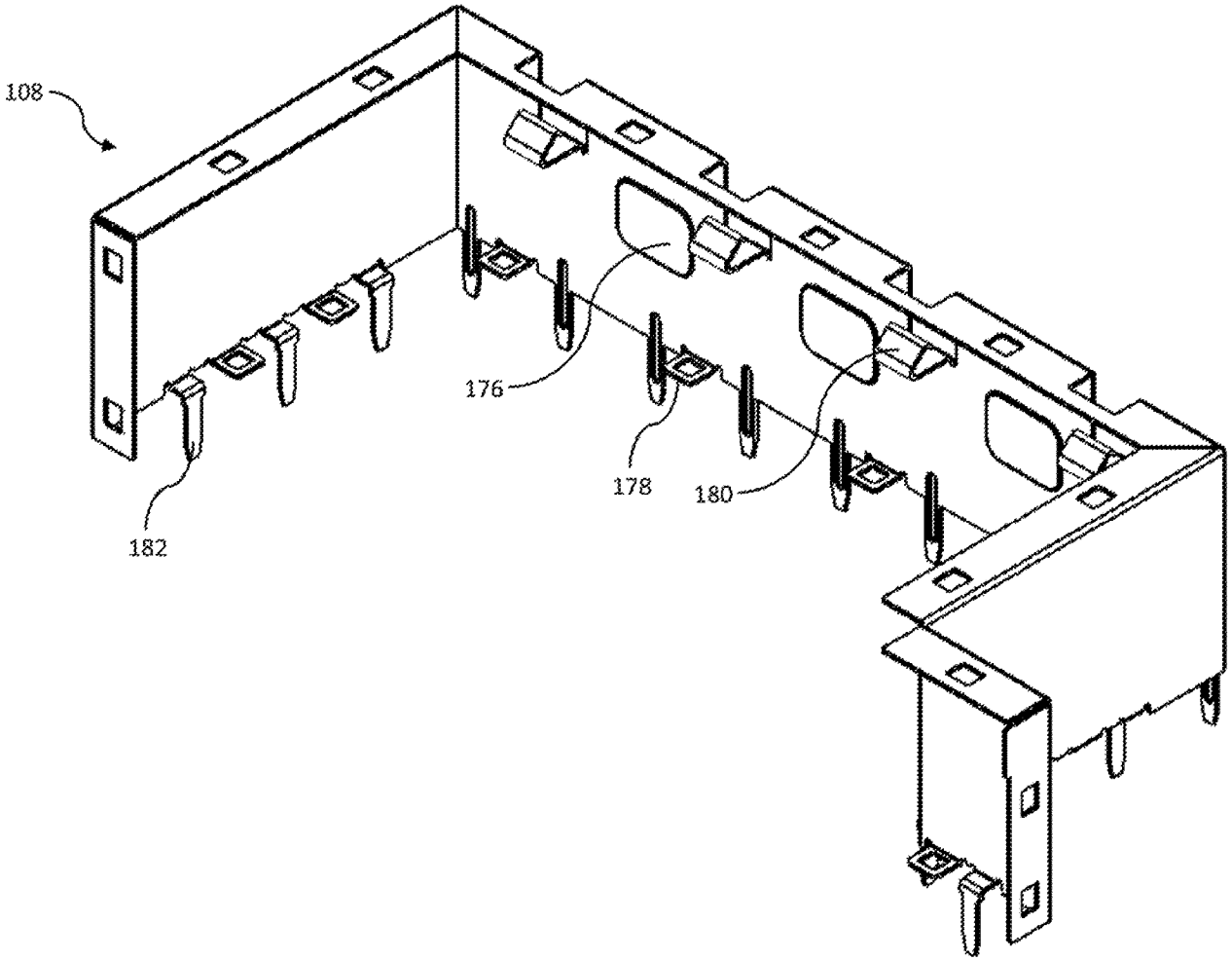
FIG. 1J is a perspective view of a back shield for use with the ICM of FIG. 1A, in accordance with the principles of the present disclosure.
Figure 1K:
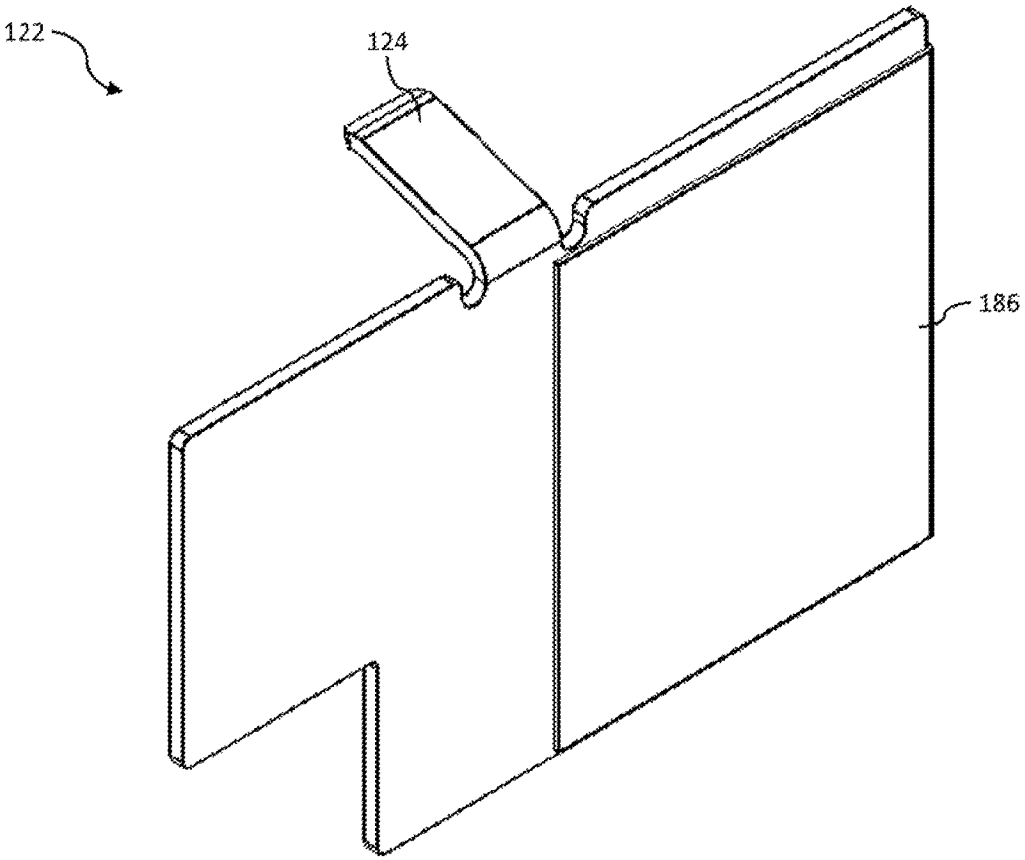
FIG. 1K is a perspective view of a port-to-port shield for use with the ICM of FIG. 1A, in accordance with the principles of the present disclosure.
Figure 1L:
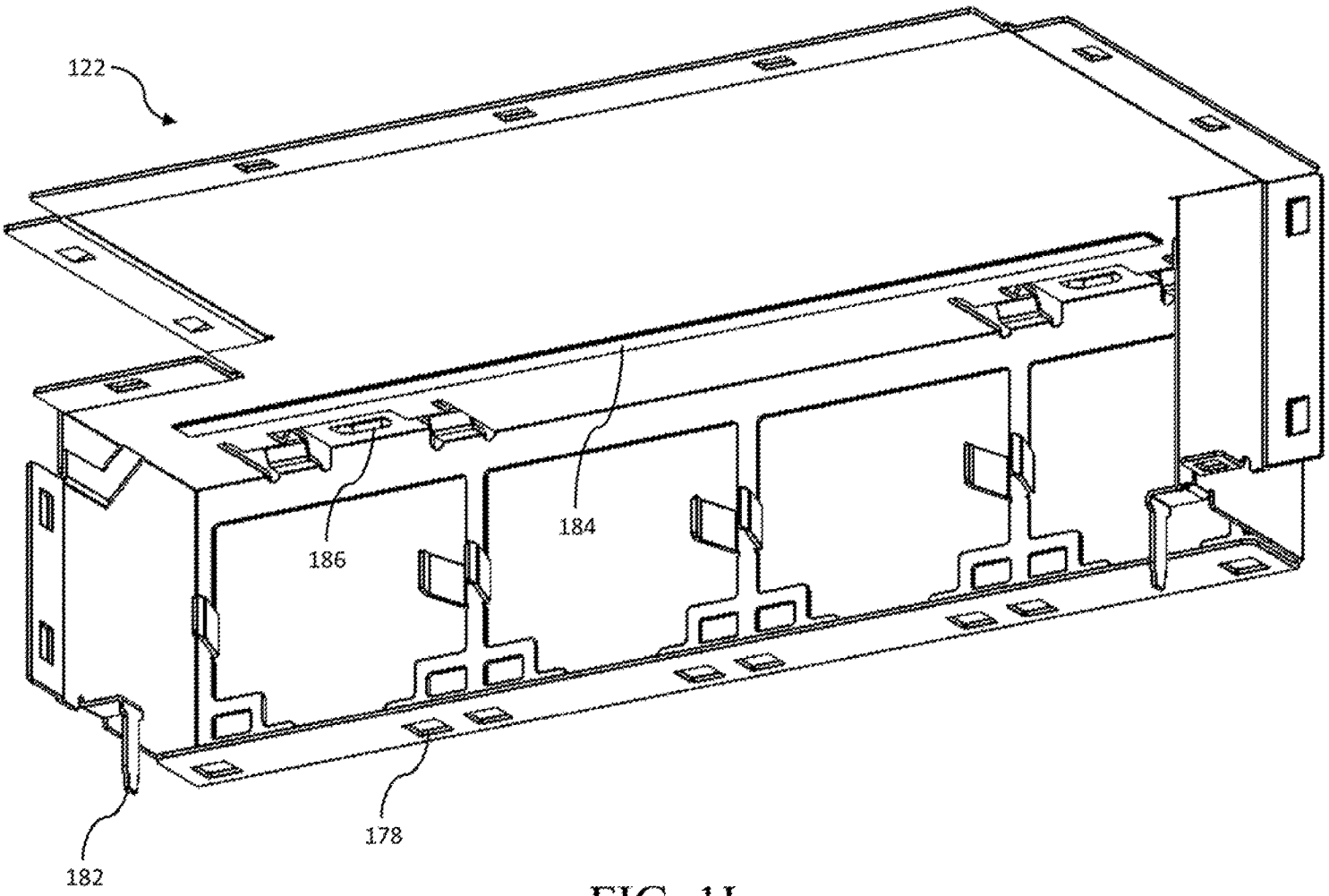
FIG. 1L is a perspective view of the back-side of the front shield for use with the ICM of FIG. 1A, in accordance with the principles of the present disclosure.

Referring now to FIGS. 1-1L, an exemplary ICM connector assembly 100, as well as various portions thereof, are shown and described in detail. FIG. 1 illustrates the ICM 100 disposed on a PCIe compliant printed circuit board 200 having a defined shape. As a brief aside, this designed shape was previously adequate for non-ICM prior art RJ-style connectors. In other words, these non-ICM prior art RJ-style connectors didn't include integrated electronic components (e.g., magnetic components). Rather, the signal conditioning circuitry was disposed within discrete components located external from the non-ICM prior art RJ-style connectors. As a result of this PCIe defined shape, as well as the fact that this defined shape only took into consideration non-ICM prior art RJ-style connectors, the available footprint for ICM 100 has, for example, the signal conditioning portion of the ICM offset from the port containing portion of the ICM 100 giving ICM 100 its offset ("zig-zag") external profile. Also, as is illustrated in FIG. 1, the PCIe compliant printed circuit board 200 may further require the inclusion of a PCIe compliant input/output (I/O) bracket 202. In some implementations, the I/O bracket 202 may interface with the ICM 100 at interface locations 204 as will be described subsequently herein.

Referring now to FIG. 1A, the ICM 100 is shown prior to being installed on the PCIe compliant printed circuit board 200 illustrated in FIG. 1. In the illustrated implementation, ICM 100 includes external shielding. Specifically, external shielding consists of a front shield 110 and a back shield 108, although it is appreciated that this shielding 108, 110 may be obviated in some implementations in which, for example, EMI to/from external electronic components is less of a concern. Additionally, while two external shields 108, 110 are illustrated in FIG. 1A, it would be readily apparent to one of ordinary skill that single shield variants (e.g., where shields 108, 110 are combined into a unitary shield) or three or more shield variants would be readily understood by one of ordinary skill given the contents of the present disclosure. The front shield 110 and the back shield 108 may interface with one another using mechanical shield interface features 114. In some implementations, shielding may be enhanced via the use of a eutectic solder at shield interface features 114 (or in some implementations, a eutectic solder may be utilized instead of shield interface features 114).

The ICM 100 may include one or more ports 102, which as depicted consists of a 1×4 port configuration (i.e., a single row of four ports 102), although it is appreciated that other port configurations (e.g., multi-row/multi-port configurations, single port configurations and the like) would be readily apparent to one of ordinary skill given the contents of the present disclosure. The ports 102 may be separated from one another via a defined pitch spacing. In some implementations, such as the aforementioned PCIe application, these ports may be spaced from one another at a defined pitch of 13.40 mm (0.528 inches). In other implementations, the defined pitch may consist of a spacing of 13.97 mm (0.550 inches) as is common in many RJ-style multi-port applications. However, it would be readily appreciated that other suitable defined pitch spacing's may be possible in alternative variants.

The illustrated ICM 100 includes a plurality of light emitting diodes (LEDs) 106 (eight (8) total as illustrated, with two LEDs per port 102). While a specific LED configuration is shown, it would be appreciated that the specific configuration shown may be obviated in favor of other configurations. For example, the LED configuration illustrated in co-owned U.S. Pat. No. 7,241,181 filed Jun. 28, 2005 and entitled "Universal Connector Assembly and Method of Manufacturing", the contents of which being incorporated herein by reference in its entirety, may be readily modified for use with ICM 100. The front shield 110 of the illustrated ICM 100 may further include resilient mounting bracket shielding tabs 112 as well as resilient mounting bracket engagement features 104 as will be described in subsequent detail herein with respect to FIG. 1L. The purpose for these shielding tabs 112 and engagement features 104 is to provide an additional ground connection (and force) between ICM 100 and I/O mounting bracket 202 as is illustrated in FIG. 1.

Referring now to FIG. 1B, ICM 100 is shown with the external shielding removed from view. In particular, the arrangement for the front housing 118 and the rear housing 116 can be more readily seen. The signal conditioning portion of the housings 118, 116 is offset from the port portion of the housings 118, 116 by an offset distance 126. This offset distance 126 is selected so as to be compliant with the PCIe specification, although it is readily appreciated that other offset distances may be chosen dependent upon the particular application being utilized. As a brief aside, many common prior ICM designs typically include a single housing. Such single housing designs are depicted in co-owned U.S. Pat. No. 7,241,181 filed Jun. 28, 2005 and entitled "Universal Connector Assembly and Method of Manufacturing", the contents of which being previously incorporated herein by reference in its entirety. However, due to the offset design of the housings 116, 118 of the illustrated ICM, this prior single housing design may no longer be feasible. Accordingly, front 118 and rear 116 housings may need to be utilized in combination with one another in order to accommodate this offset design. In the illustrated implementation, the front 118 and rear 116 housing include mortise/tenon joints 120 in order to securely position (and secure) these housings 118, 116 with respect to one another. Although the use of mortise/tenon joints 120 is exemplary in the illustrated embodiment, it would be readily apparent that these joints 120 may be replaced (or used in conjunction with) other mechanical methods including, without limitation, post/receptacles, butt joints (e.g., basic and/or mitered, etc.), half-lap joints, tongue and groove joints, biscuit joints, pocket joints, dado joints, rabbet joints, dovetail joints (e.g., through, half-blind, sliding, etc.), box joints and/or other types of joining methods. Moreover, these aforementioned joints may be used in combination with epoxies, clips, heat staking and/or other types of materials and/or processes by which these housings 118, 116 may be joined together.

In some implementations, such as that illustrated in FIG. 1B, the ports 102 may be isolated from one another via the use of conductive port-to-port shields 122 as will be described with respect to FIG. 1K described subsequently herein. As illustrated, these port-to-port shields 122 may further include a port-to-port shielding tab 124. This port-to-port shielding tab 124 may act as a spring interface to, for example, the front shield 110. Moreover, this spring interface may be soldered to, for example, the front shield 110 in certain implementations, or may be obviated in favor of (or used in combination with) other methods including, for example, a through hole connection between the front shield 110 and tab 124. The use of port-to-port shields 122 may be important in high data throughput applications such as, and without limitation, the aforementioned Gigabit Ethernet standards as they may, inter alia, eliminate or minimize cross-talk between adjoining ports 102 (e.g., Alien Near End Crosstalk (ANEXT) and the like).

Referring now to FIG. 1C, a rear perspective view of the front housing 118 illustrated in, for example, FIG. 1B is shown and described in detail. The overall shape of the mortice/tenon features 120 may now be more readily apparent. The front housing 118 may also include alignment posts 130 as is well understood in the connector arts. Of note however, is the inclusion of a plurality of insert-to-insert shield receiving features 134 located on the top portion of the housing 118. The insert-to-insert shield receiving features 134 are configured to accept a portion of the insert-to-insert shield assembly 152 as is illustrated in, for example, FIG. 1E. One of the salient features of these insert-to-insert shield receiving features 134 is to ensure proper alignment of the FCC inserts (148, FIG. 1E) when disposing the insert assembly (142, FIG. 1E) into respective ones of the ports 102. The insert-to-insert shield receiving features 134 start at respective mortise/tenon features 120 in the illustrated implementation, although it is appreciated that the mortise/tenon features 120 may be included, for example, in between respective ones of the insert-to-insert shield receiving features 134. Also of note is the inclusion of insert receptacles 132 which further help to align the insert assembly (142, FIG. 1E) when being assembled with the front housing 118. Also of note is the inclusion of shield engagement features 128 which are configured to engage with respective ones of the housing engagement features (178, FIGS. 1J and 1L). The shield engagement features 128 as depicted are formed in the shape of cantilever beams with a snap feature. This cantilever beam shape enables a level of resilience for the shield engagement features 128 when the front shield 110 (or back shield 108) is "snapped" thereon. While the depicted shape for the shield engagement features 128 is exemplary, it would be readily apparent to one of ordinary skill given the contents of the present disclosure that other suitable forms may be readily substituted. For example, the shield engagement features 128 may include non-cantilever beam snap features, heat staking features and the like in alternative implementations.

Referring now to FIG. 1D, a perspective view of the rear housing 116 is shown and described in detail. The rear housing 116 may include an offset ("zig-zag") external profile that is configured to align with the similar external profile of the front housing 118. The front 118 and rear housings 116 may interface with one another via the inclusion of mortise/tenon joints 120. As depicted, the rear housing 116 may include one male mortise/tenon joint 120 and a number (e.g., four (4) as depicted) female mortise/tenon joints 120, although it would be apparent to one of ordinary skill given the contents of the present disclosure that the type (and/or number) of mortise/tenon joints 120 may be readily varied. The rear housing 116 may also include a number of insert receiving features 136 which are configured to accept respective features on the inserts (e.g., insert posts 168, FIG. 1H). One such advantage for these insert receiving features 136 and insert posts 168 is the ability to facilitate alignment of the insert assemblies (142, FIGS. 1E-1G) with respect to the rear housing 116. The rear housing 116 may also include rear shielding tab apertures 138 which enable respective ones of the rear shielding tabs (174, FIG. 1I) to engage the back shield 108. Similarly, the rear housing 116 may also include circuit board shielding tab apertures 140 which enable the printed circuit board engagement tabs (180, FIG. 1J) located on the back shield 108 to engage the upper substrate (144, FIG. 1E) as will be described subsequently herein.

Referring now to FIG. 1E, a perspective view of an exemplary insert assembly 142 is shown and described in detail. As depicted, the insert assembly 142 includes four (4) FCC inserts 148 along with four (4) header inserts 150, although it is appreciated that more (or less) header inserts 150 and FCC inserts 148 may be utilized in alternative implementations. The insert assembly 142 further includes an upper substrate 144 that is, as illustrated, common for each of the header inserts 150 and each of the FCC inserts 148, although it would be appreciated that such commonality isn't essential in alternative variants of the ICM 100. For example, in some implementations it may be advantageous to include a single upper substrate 144 for each header insert 150, or to include a single upper substrate 144 for pairs of header inserts 150, etc. These and other variants would be readily apparent to one of ordinary skill given the contents of the present disclosure. The upper substrate 144 may include a number of upper shielding tab interfaces 146 (e.g., one for each header insert 150). In some implementations, the upper shielding tab interfaces 146 may be configured to be coupled to a high voltage capacitor ground. As described supra, these upper shielding tab interfaces 146 may be configured to engage the back shield 108 via printed circuit board engagement tabs (180, FIG. 1J) in alternative implementations. The upper shielding tab interfaces 146 may be coupled to a ground plane within the upper substrate 144. The upper substrate 144 may include a number of slots with these slots configured to accommodate the insert-to-insert shield assemblies 152 as well as to accommodate the port-to-port shields 122. The insert-to-insert shield assemblies 152 as well as to the port-to-port shields 122 are offset from one another. As depicted, the FCC inserts 148 are configured to interface with the upper substrate 144 via a through-hole connection. However, in alternative variants, the FCC insert 148 may be coupled to the upper substrate via surface mount terminations such as those described in co-owned U.S. Pat. No. 7,241,181 filed Jun. 28, 2005 and entitled "Universal Connector Assembly and Method of Manufacturing", the contents of which being previously incorporated herein by reference in its entirety. Circuit board traces on the upper substrate 144 may route electrical signals to/from the FCC inserts 148.

Referring now to FIG. 1F, the underside of the insert assembly 142 of FIG. 1E is shown and described in detail. In particular, the insert assembly 142 further includes a plurality of lower substrates 156. These lower substrates 156 are configured to receive the lower terminals 160 of the header inserts 150. While a plurality of lower substrates 156 are depicted, it would be readily apparent to one of ordinary skill given the contents of the present disclosure that the lower substrates 156 may be combined into a single common substrate for two or more header inserts 150. The lower substrate(s) 156 may include a substrate shield as disclosed in, for example, co-owned U.S. Pat. No. 7,241,181 filed Jun. 28, 2005 and entitled "Universal Connector Assembly and Method of Manufacturing", the contents of which being previously incorporated herein by reference in its entirety, in some implementations. Each of the header inserts 150 may include a plurality of electronic components 154 disposed therein. In some implementations, the electronic components may include wire wound magnetics (e.g., a wound toroid); although it would be readily apparent to one of ordinary skill given the contents of the present disclosure that the types of electronic components disposed within the header inserts 150 is not so limited.

Referring now to FIG. 1G, the insert assembly 142 is again illustrated with the upper substrate 144 removed from view. As can be now seen, the upper substrate 144 includes a plurality of electronic components 154 that are configured to be mounted to the underside of the upper substrate. In the illustrated depiction, these electronic components may include surface mountable chip components (e.g., resistors, capacitors and the like), although it would be appreciated that other types of electronic components may be utilized in alternative variants. Each of the header inserts 150 may include a plurality of upper terminals 162. These upper terminals may be configured to interface with the upper substrate 144 via the use of a through-hole type interface. In some implementations, some (or all) of these upper terminals may be obviated in favor of alternative interface techniques including surface mount connections, or those alternative termination types described in co-owned U.S. Pat. No. 9,716,344 filed Nov. 6, 2013 and entitled "Apparatus for Terminating Wire Wound Electronic Components to an Insert Header Assembly" as well as co-owned U.S. Pat. No. 9,401,561 filed Mar. 10, 2014 and entitled "Methods And Apparatus For Terminating Wire Wound Electronic Components To A Header Assembly", the contents of each of the foregoing being incorporated herein by reference in its entirety.

Referring now to FIG. 1H, a perspective view of an exemplary header insert 150 is shown and described in detail. The exemplary header insert 150 may include an insert protrusion 158 that is configured to be received within an insert receptacle (132, FIG. 1C) of the front housing 118. The insert protrusion 158 is configured to facilitate alignment of the header insert 150 with respect to front housing 118. While the insert protrusion 158 is depicted has having a generally rectangular shape, alternative variants may include protrusions have other perimeter profiles including round shapes (e.g., one or more posts), or other polygon type shapes (e.g., one or more square posts, hexagonal posts, octagonal posts, etc.). In some variants, the protrusion 158 and receptacle (132, FIG. 1C) may be effectively switched such that the header insert 150 includes a receptacle while the respective protrusion is located on the front housing 118. These and other variants would be readily apparent to one of ordinary skill given the contents of the present disclosure. The header insert 150 may also include one or more electronic component receiving cavities 166. For example, the header insert 150 may include one electronic component receiving cavity 166 that is separated by an isolating wall of the header insert from a second electronic component receiving cavity. When the electronic components contained within the electronic component receiving cavity 166 include one or more wire wound electronic components (e.g., wound toroids), the wire ends for these electronic components may be routed to respective ones of the upper terminals 162 and/or lower terminals 160. In some implementations, individual ones of the upper 162 and/or lower terminals 160 may include flattened portions 164. These flattened portions 164 may facilitate the wire wrapping of wire ends for wire wound electronic components disposed within the electronic component receiving cavities 166 and may further be included on two opposing sides of the terminals 162 and/or 160. Disposed adjacent these terminals 160/162, the header insert 150 may further include channels which facilitates the routing of wires as well as prevents damage to these wires when the header inserts 150 is, inter alia, disposed within the front housing 118. The top portion of the header insert 150 may further include a number of standoff features. Some of these standoff features may include posts that are configured to be received within respective apertures located on the upper substrate 144, which further aids in alignment during assembly.

Referring now to FIG. 1I, a perspective view of an exemplary insert-to-insert shield assembly 152 is shown and described in detail. In the illustrated implementation, the insert-to-insert shield assembly 152 may include a conductive material (such as the conductive rear shielding tab 174) disposed within a non-conductive rear shield housing 172. In some implementations, this rear shield housing may be formed from a polymer type material and may further include a first segment 172*a* and a second segment 172*b* that are attached to one another once the rear shielding tab 174 has been disposed there between. The rear shield housing 172 may further include a bottom substrate engagement feature 170 that facilitates, inter alia, the alignment and spacing of the lower substrates 156. In some implementations, the rear shield housing 172 may be obviated altogether. For example, the rear shield tab 174 may be lengthened so as to engage both the upper substrate 144 and lower substrate 156 directly. These and other variants would be readily apparent to one of ordinary skill given the contents of the present disclosure.

Referring now to FIG. 1J, a perspective view of an exemplary back shield 108 is shown and described in detail. The illustrated back shield includes the offset ("zig-zag") profile illustrated with respect to the housings 116, 118. The back shield 108 may include a plurality of PCB tines 182 as well as a number of housing engagement features 178 as was described previously supra. The illustrated PCB tines 182 are configured to be received within through holes on an end customer printed circuit board (such as PCB 200 illustrated in FIG. 1). In some variants, the illustrated PCB tines 182 may be obviated in favor of press-fit contacts such as those described in, for example, co-owned U.S. Pat. No. 9,178,318 filed Mar. 12, 2013 and entitled "Shielded Integrated Connector Modules and Assemblies and Methods of Manufacturing and Use", the contents of which being incorporated herein by reference in its entirety. The back shield 108 may include rear shield tab engagement features 176 which is configured to engage the rear shielding tab (174, FIG. 1I). In some implementations (as is illustrated), the rear shield tab engagement feature 176 may be stamped into the back shield 108 such that this engagement feature 176 is strengthened so as to ensure adequate engagement pressure with the rear shielding tab (174, FIG. 1I). The back shield 108 may further include PCB engagement tabs 180. In some implementations, the PCB engagement tabs 180 are configured to be positioned underneath the upper substrate 144 adjacent to the upper substrate shielding tab interface 146. Accordingly the PCB engagement tabs 180 are configured to apply upward pressure on, for example, a high voltage capacitor located on the upper substrate shielding tab interface 146 the so that this high voltage capacitor makes direct contact with the back 108 and/or front shield 110.

Referring now to FIG. 1K, a perspective view of an exemplary port-to-port shield 122 is disclosed. The port-to-port shield 122 may include a port-to-port shielding tab 124 in some implementations. This port-to-port shielding tab 124 may be configured to interface with a respective engagement feature (184, FIG. 1L) located on the front shield 110 so as to provide an additional point of grounding for the ICM 100. The port-to-port shield 122 may further include an encapsulating portion 186 which is made from a non-conductive material (e.g., Mylar tape, polymer, etc.) which helps isolate the port-to-port shield 122 from other circuitry contained within ICM 100. In some implementations, the port-to-port shield 122 may be formed from a unitary shielding material that is formed along with the insert-to-insert shield assembly 152, resulting in an offset ("zig-zag") unitary shield. These and other variants would be readily apparent to one of ordinary skill given the contents of the present disclosure.

Referring now to FIG. 1L, a rear perspective view of the front shield 110 is shown and described in detail. The illustrated front shield 110 includes the offset ("zig-zag") profile illustrated with respect to the housings 116, 118. Front shield 110 may also include main PCB tines 182 as well as housing engagement features 178 similar to that discussed supra with respect to FIG. 1J. For example, the illustrated PCB tines 182 are configured to be received within through holes on an end customer printed circuit board (such as PCB 200 illustrated in FIG. 1). In some variants, the illustrated PCB tines 182 may be obviated in favor of press-fit contacts such as those described in, for example, co-owned U.S. Pat. No. 9,178,318 filed Mar. 12, 2013 and entitled "Shielded Integrated Connector Modules and Assemblies and Methods of Manufacturing and Use", the contents of which being previously incorporated herein by reference in its entirety. The front shield 110 may also include mounting bracket engagement features 186. These engagement features 186 may be stamped from the underlying front shield material such that they provide a resilient contact with respect to the retention features (204, FIG. 1) located on the mounting bracket (202, FIG. 1).

Figure 2:
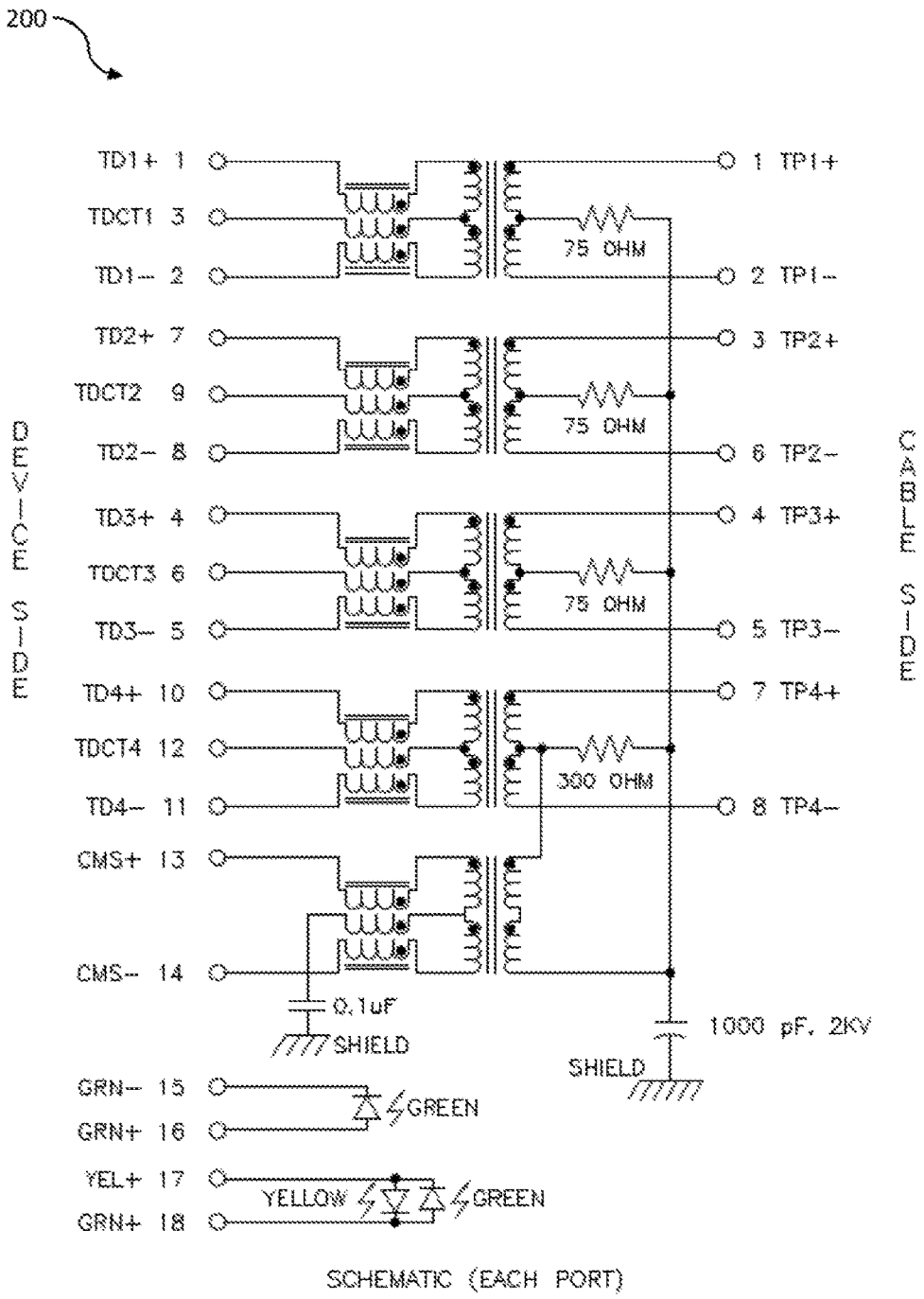
FIG. 2 is a schematic for an exemplary electronic components package for use with the ICM of FIG. 1A, in accordance with the principles of the present disclosure.

Referring now to FIG. 2, a schematic for an exemplary electronic components package 200 for use with the ICM illustrated in, for example, FIG. 1A is shown and described in detail. As illustrated, the schematic illustrated is for use with so-called 10G applications, although it would be readily apparent to one of ordinary skill that the specific schematic illustrated may be substituted with other suitable electronic components packages in alternative variants. For example, the electronics components package may be adapted for use with so-called 1G, 2.5G, 5G, etc., electronics components packages in certain variants. Table 1 reproduced infra illustrate various electrical characteristic requirements for the electronic components package 200 illustrated in FIG. 2. Table 2 reproduced infra illustrates the electrical requirements for exemplary LEDs (106, FIG. 1E).

TABLE 1

| ELECTRICAL CHARACTERISTICS AT +25° C. UNLESS OTHER SPECIFIED | | | |
|---|---|---|---|
| PARAMETER | SPECIFICATIONS | | |
| OPERATING TEMP | 0° C. TO +85° C. | | |
| TURNS RATIO | 1.00 ± 2% | | |
| POLARITY | PER SCHEMATIC | | |
| INDUCTANCE, DATA CHANNELS | 160 uH MIN @ 100 kHz, 100 mV | | |
| INDUCTANCE, 5TH CHANNEL | 40 uH MIN @ 100 kHz, 100 mV | | |
| INSERTION LOSS, dB MAX | 1-5 MHz | 5-200 MHz | 200-400 MHz |

TABLE 1-continued

| ELECTRICAL CHARACTERISTICS AT +25° C. UNLESS OTHER SPECIFIED | | | | |
|---|---|---|---|---|
| PARAMETER | SPECIFICATIONS | | | |
| (DATA CHANNELS, SDD21) | −.575 + (.025 * f) | −.4425 − (.001645 * f) | −.1315 − (.0032 * f) | |
| RETURN LOSS, dB MIN | 1-40 MHz | 40-400 MHz | 400-500 MHz | |
| (PHY SIDE, SDD11) | −18 | −18 + 10 * LOG (f/40) | −8 + 30 * LOG (f/400) | |
| RETURN LOSS, dB MIN | 1-100 MHz | 100-300 MHz | 300-600 MHz | 600-800 MHz |
| (LINE SIDE, SDD22) | −20 | −23.3 + (0.31 * f) | −17.8 + (.01333 * f) | −32.31 + (.0375 * f) |
| CROSSTALK, ADJACENT | 1-350 MHz | | 350-500 MHz | |
| CHANNELS | −34.03 + (F/31.73) | | −23 | |
| COMMON MODE REJECTION | 1-500 MHz | 500-800 MHz | 800-1000 MHz | |
| RATIO SCC12 dB MAX | −22.004 − (F/249.5) | −20 | −32 + (.015 * f) | |
| COMMON TO DIFFERENTIAL | 1-200 MHz | 200-380 MHz | 380-500 MHz | |
| MODE REJECTION (CDMR) | −40.05 + (.05025 * f) | −44.438 + (.0722 * f) | −17 | |
| INSERTION LOSS, dB MAX | 1-400 MHz | | | |
| (5TH CHANNELS, SDC12) | −7 dB MIN, 0 dB MAX | | | |
| CURRENT CARRYING | 500 mA MAX | | | |
| CAPABILITY, RJ45 PINS 1-8 | | | | |
| INPUT - OUTPUT | 1500 VAC MIN @ 60 SECONDS | | | |
| ISOLATION | | | | |

NOTE:
f IS FREQUENCY IN MHz.

TABLE 2

| | | | |
|---|---|---|---|
| EMMITTED COLOR | GREEN | GREEN | YELLOW |
| WAVELENGTH (nM) | 570 | 570 | 566 |
| POWER DISSIPATION (Pd) | 85 mW MAX | 85 mW MAX | 85 mWMAX |
| DC FORWARD CURRENT | 30 mA MAX | 30 mA MAX | 30 mA MAX |
| FORWARD VOLTAGE (VF) @ 20 mA | 2.2 V TYP | 2.2 V TYP | 2.2 V TYP |
| | BICOLOR | | |

Method of Manufacture—

Figure 3:
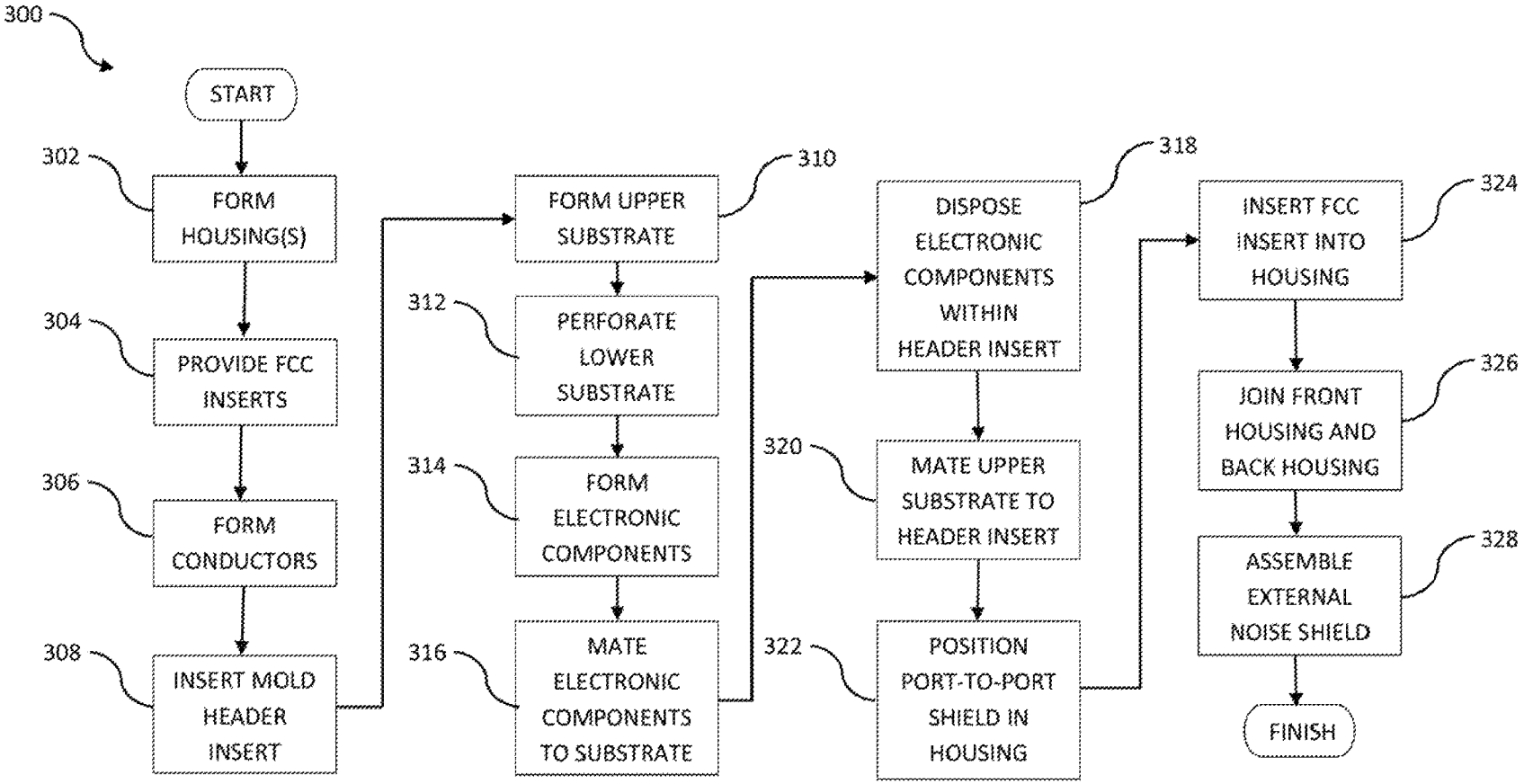
FIG. 3 is a logical flow diagram of an exemplary method of manufacturing the ICM of FIG. 1A, in accordance with the principles of the present disclosure.

Referring now to FIG. 3, the method 300 of manufacturing the aforementioned ICM assembly 100 is described in detail. It is noted that while the following description of the method 300 of FIG. 3 is cast in terms of the multiple port 102 ICM assembly of FIG. 1, the broader method of the invention is equally applicable to other configurations (including e.g., a single-port embodiment, or multi-row and multi-column embodiments described supra).

In the embodiment of FIG. 3, the method 300 generally comprises first forming the front 118 and rear housings 116 in step 302. The housings may be formed using an injection molding process of the type well known in the art, although other processes may be used. The injection molding process is chosen for its ability to accurately replicate small details of the mold, low cost, and ease of processing.

Next, FCC inserts 148 (e.g., conductor sets) are provided in step 304. The conductor sets may comprise metallic (e.g., copper or aluminum alloy) strips having a substantially square or rectangular cross-section and sized to fit within the slots of the port(s) 102 of the front housing 118. The FCC inserts 148 may also include an injection molded polymer which is configured to, inter alia, maintain the spacing between individual ones of the conductors.

In step 306, the conductors are formed to the desired shape(s) using a forming die or machine of the type well known in the art.

In step 308, the header insert 150 is insert-molded with respective upper terminals 162 and lower terminals 160, thereby forming the component shown in FIG. 1H.

Next, the upper substrate 144 is formed and perforated through its thickness with a number of apertures of predetermined size in step 310. Methods for forming substrates are well known in the electronic arts, and accordingly are not described further herein. Any conductive traces on the substrate required by the particular design are also added, such that necessary ones of the conductors, when received within the apertures, are in electrical communication with the traces.

Next, the lower substrate 156 is formed and is perforated through its thickness with a number of apertures of predetermined size in step 312. The apertures are arranged in an array of perforations which receive corresponding ones of the lower terminals 160 therein, the apertures of the lower substrate acting to register and add mechanical stability to the lower terminals. Alternatively, the apertures may be formed at the time of formation of the substrate itself.

In step 314, one or more electronic components, such as the aforementioned toroidal coils and surface mount devices, are next formed and prepared (if used in the design). The manufacture and preparation of such electronic components is well known in the art, and accordingly is not described further herein.

The relevant electronic components are then mated to the upper substrate 144 in step 316. Note that if no components are used, the conductive traces formed on/within the primary substrate will form the conductive pathway between the FCC inserts 148 and respective ones of the upper terminals 162. The components may optionally be (i) received within corresponding apertures designed to receive portions of the component (e.g., for mechanical stability), (ii) bonded to the substrate such as through the use of an adhesive or encapsulant, (iii) mounted in "free space" (i.e., held in place through tension generated on the electrical leads of the component when the latter are terminated to the substrate conductive traces and/or conductor distal ends, or (iv) maintained in position by other means. In one embodiment, the surface mount components are first positioned on the primary substrate, and the magnetics (e.g., toroids) positioned thereafter, although other sequences may be used. The components are electrically coupled to the PCB using a eutectic solder re-flow process as is well known in the art.

In step 318, the remaining electrical components are disposed within the cavity of the header insert 150 and wired electrically to the appropriate ones of the upper and lower terminals 162, 160. This wiring may comprise wrapping, soldering, welding, or any other suitable process to form the desired electrical connections.

In step 320, the assembled upper substrate with electronic components is then mated with the header insert 150 and its components, specifically such that the upper terminals 162 are disposed in their corresponding apertures of the substrate 144. The terminals 162 are then bonded to the substrate contacts such as via soldering or welding to ensure a rigid electrical connection for each. The completed header insert 150 may be electrically tested to ensure proper operation if desired.

In step 322, the port-to-port shield 122 is positioned within the front housing 118 and the insert-to-insert shield is positioned between adjacent header inserts 150.

In step 324, the FCC inserts 148 previously formed are inserted within their grooves formed in the ports 102 of the front housing 118, and snapped into place along with the formed header inserts 150 and upper 144 and lower substrates 156.

In step 326, the front housing 118 is joined with the rear housing 116 using, for example, the aforementioned mortise/tenon joints 120.

Lastly, in step 328, the external noise shield(s) 108, 110 (if used) is fitted onto the assembled housings, and the various ground straps and clips as previously described herein are positioned so as to provide grounding of the noise shield.

With respect to the other embodiments described herein, the foregoing method may be modified as necessary to accommodate the additional components. Such modifications and alterations will be readily apparent to those of ordinary skill, given the disclosure provided herein.

It will be recognized that while certain aspects of the present disclosure are described in terms of specific design examples, these descriptions are only illustrative of the broader methods of the disclosure, and may be modified as required by the particular design. Certain steps may be rendered unnecessary or optional under certain circumstances. Additionally, certain steps or functionality may be added to the disclosed embodiments, or the order of performance of two or more steps permuted. All such variations are considered to be encompassed within the present disclosure described and claimed herein.

While the above detailed description has shown, described, and pointed out novel features of the present disclosure as applied to various embodiments, it will be understood that various omissions, substitutions, and changes in the form and details of the device or process illustrated may be made by those skilled in the art without departing from the principles of the present disclosure. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

What is claimed is:

1. An integrated connector module (ICM), comprising:

a plurality of shielding components, the plurality of shielding components comprising a port to port shield, an insert-to-insert shield and a main body shield;

a plurality of housing components, comprising a first housing component comprising at least a signal conditioning portion, the first housing engaging with a second housing component comprising at least a plurality of ports associated with a direction of insertion, the first and second housing components being arranged so as to be offset with respect to each other in a dimension perpendicular to the direction of insertion such that the signal conditioning portion and the plurality of ports are collectively offset with respect to each other in the dimension perpendicular to the direction of insertion; and an electronics assembly disposed within the signal conditioning portion of the one or more housing components.

2. The ICM of claim 1, wherein each of the port to port shield, the insert-to-insert shield and the main body shield each comprise discrete shielding elements.

3. The ICM of claim 2, further comprising a plurality of header inserts and an upper substrate, at least a portion of the electronics assembly being collectively disposed within the plurality of header inserts and the upper substrate.

4. The ICM of claim 3, wherein the upper substrate is disposed atop the plurality of header inserts, the upper substrate comprising a unitary component such that the upper substrate is common to each of the plurality of header inserts.

5. The ICM of claim 2, wherein the port to port shield further comprises a port to port shielding tab, the port to port shielding tab configured to engage the main body shield.

6. The ICM of claim 5, wherein the main body shield comprises a front shield and a back shield, the port to port shielding tab configured to engage the front shield.

7. The ICM of claim 6, wherein the insert-to-insert shield comprises a rear shielding tab, the rear shielding tab configured to engage the back shield.

8. The ICM of claim 1, wherein the plurality of housing components are configured to engage one another via one or more mortise/tenon joints.

9. A printed circuit card for use in a standardized application, the printed circuit card comprising:

a printed circuit board having an integrated connector module mounted thereon; and an input/output (I/O) mounting bracket;

wherein the integrated connector module comprises:

a plurality of shielding components, the plurality of shielding components comprising a port to port shield, an insert-to-insert shield and a main body shield;

one or more housing components, the one or more housing components comprising a plurality of ports that are arranged so as to be collectively offset from a signal conditioning portion of the one or more housing components; and an electronics assembly disposed within the signal conditioning portion of the one or more housing components.

10. The printed circuit card of claim 9, wherein:

each of the plurality of ports of the integrated connector module comprises an RJ-type port; and the standardized application is in accordance with a Peripheral Component Interconnect Express (PCIe) application.

11. The printed circuit card of claim 9, wherein the main body shield comprises a mounting bracket engagement feature, the mounting bracket engagement feature comprising a resilient portion configured to apply pressure to the I/O mounting bracket.

12. The printed circuit card of claim 9, wherein the signal conditioning portion comprises one or more magnetic components each configured to perform one or more of (i) signal voltage transformation and (ii) filtering of signals; and wherein the electronics assembly comprises at least one of the one or more magnetic components of the signal conditioning portion.

13. An integrated connector module (ICM), comprising:

a main housing having a plurality of header inserts mounted at least partially therein, the plurality of header inserts having an upper substrate mounted thereto;

a plurality of shielding components, the plurality of shielding components comprising:

a port to port shield, the port to port shield being disposed between adjacent ones of at least some of a plurality of ports located within the main housing;

an insert-to-insert shield, the insert-to-insert shield being disposed between adjacent ones of the plurality of header inserts; and a main body shield, the main body shield being disposed at least partly about the main housing and formed in a zigzag shape, the zigzag shape of the main body shield having at least one pair of opposing sides each comprising at least one stepped portion so as to create an offset between another pair of opposing sides of the main body shield; and an electronics assembly disposed within a signal conditioning portion of the main housing, the signal conditioning portion being offset from the plurality of ports by a specified distance at least by virtue of the zigzag shape.

14. The ICM of claim 13, wherein use of the port to port shield enables suppression of Alien Near End Crosstalk (ANEXT) as compared with a similar ICM that does not contain the port to port shield.

15. The ICM of claim 13, wherein the port to port shield further comprises a port to port shielding tab, the port to port shielding tab configured to resiliently engage the main body shield.

16. The ICM of claim 15, wherein the main body shield comprises a front shield and a back shield, the port to port shielding tab configured to resiliently engage the front shield.

17. The ICM of claim 16, wherein the insert-to-insert shield comprises a rear shielding tab, the rear shielding tab configured to resiliently engage the back shield.

18. The ICM of claim 17, wherein the insert-to-insert shield comprises a discrete shielding element from the port to port shield.

19. The ICM of claim 13, wherein the main housing collectively comprises a port portion and a signal conditioning portion, the port portion being offset from the signal conditioning portion.

20. The ICM of claim 19, wherein the main housing comprises a front housing and a rear housing, the front housing including both the port portion and the signal conditioning portion.

21. The ICM of claim 20, wherein the rear housing includes both the port portion and the signal conditioning portion.

22. The ICM of claim 13, wherein the plurality of ports are arranged in a 2×N array.

23. An integrated connector module (ICM), comprising:

a main housing having a plurality of ports and a respective plurality of inserts received at least partially therein, the plurality of inserts each having a plurality of electrical terminals, the plurality of inserts having a common upper substrate mounted thereto; and an electronics assembly disposed within a signal conditioning portion of the main housing, the signal conditioning portion being laterally offset from the plurality of ports by a specified distance such that at least one of the plurality of ports has no signal conditioning components of the signal conditioning portion directly behind at least a majority of the electrical terminals thereof.

* * * * *